US005460012A

United States Patent [19]

Kwok

[11] Patent Number: 5,460,012

[45] Date of Patent: Oct. 24, 1995

[54] COOLING APPARATUS

[76] Inventor: Stanley K. M. Kwok, Flat H, 16/F, Tsuen Fung Centre, 168 Sai Lau Kok Street, Tsuen Wan, New Territories, Hong Kong

[21] Appl. No.: 290,365

[22] Filed: Aug. 12, 1994

[30] Foreign Application Priority Data

Oct. 26, 1993 [GB] United Kingdom ..... 9321998

[51] Int. Cl.[6] ..... F28F 7/00; F25D 23/12

[52] U.S. Cl. ..... 62/224; 62/259.3; 165/46; 606/22

[58] Field of Search ..... 62/259.3, 293, 62/222, 168, 224; 165/46; 128/DIG. 27; 606/25, 22

[56] References Cited

U.S. PATENT DOCUMENTS

| | | | |
|---|---|---|---|
| 3,295,594 | 1/1967 | Hopper | 62/259.3 |
| 4,129,432 | 12/1978 | Garside | 62/222 |
| 4,736,530 | 4/1988 | Lakic et al. | 165/46 X |
| 4,744,100 | 5/1988 | Wang | 62/259.3 X |

FOREIGN PATENT DOCUMENTS

| | | |
|---|---|---|
| 0250863 | 6/1986 | Germany . |
| 469753 | 10/1935 | United Kingdom . |
| 1003769 | 9/1965 | United Kingdom . |
| 1531647 | 11/1978 | United Kingdom . |
| 2005000 | 4/1979 | United Kingdom . |
| 2017287 | 10/1979 | United Kingdom . |
| 8302562 | 8/1983 | WIPO . |

*Primary Examiner*—William E. Wayner
*Attorney, Agent, or Firm*—Ostrolenk, Faber, Gerb & Soffen

[57] ABSTRACT

Cooling apparatus is disclosed which comprises a reservoir for compressed, preferably liquified, gas, the reservoir being connected to tubing 130 arranged to be disposed in an article of clothing adjacent to the skin of a user. A solenoid 230 is provided for opening a valve 240 between the reservoir 100 and the tubing 130 to allow pressurized gas to evaporate and escape from the reservoir along tube 130. As the gas evaporates it cools due to latent heat of evaporation thus providing a cooling effect to the user due to heat transfer through the walls of tubing. A control device 200 is provided for regulating the output of cooling gas in dependence on temperature.

11 Claims, 6 Drawing Sheets

COOLING APPARATUS

BACKGROUND AND FIELD OF THE INVENTION

This invention relates to cooling apparatus more specifically but not exclusively, to apparatus to cooling articles of clothing.

It is often necessary for the individual, particularly in a hot climate, to employ external means to keep cool, for example by using a portable fan. It is an object of the invention to provide an improved apparatus for cooling the individual.

SUMMARY OF THE INVENTION

According to the invention there is provided cooling apparatus comprising a reservoir for containing gas under pressure, temperature controlled valve means for releasing the gas from the reservoir; and means connected to the valve means for conducting the released gas to a region to be cooled thereby.

In the described embodiment as gas is released from the reservoir, the gas will expand to ambient pressure and as the gas expands it cools due to latent heat of evaporation thus providing a cooling effect to the user due to heat transfer through the conducting means.

Preferably the cooling apparatus of the invention is portable and is of sufficiently small size to be concealed within or attached to the user's clothing, with the conducting means preferably being in the form of a heat conductive tube which may be applied the body, for example in the neck region or may be threaded or otherwise engaged with clothing, for example in pockets formed in the material of a shirt or embedded on the inner surface of the sole of a shoe. Preferably, the compressed gas is in liquified form such as liquid nitrogen and means are provided for refilling the gas reservoir from a replenishment canister in similar manner to the way a gas cigarette lighter is recharged with butane.

BRIEF DESCRIPTION OF THE DRAWINGS

An embodiment of the invention will now be described by way of example with reference to the accompanying drawings in which.

DETAILED DESCRIPTION OF THE PREFERRED EMBODIMENT

With reference to the drawings an embodiment of the invention is shown which comprises a reservoir 100 for containing a compressed, preferably liquified gas e.g. nitrogen, the reservoir 100 having a filling/refilling inlet 110 which includes a one-way inlet valve of conventional construction and, an outlet 120 connected to a tube 130 open at its free end (not shown).

Figure 1:
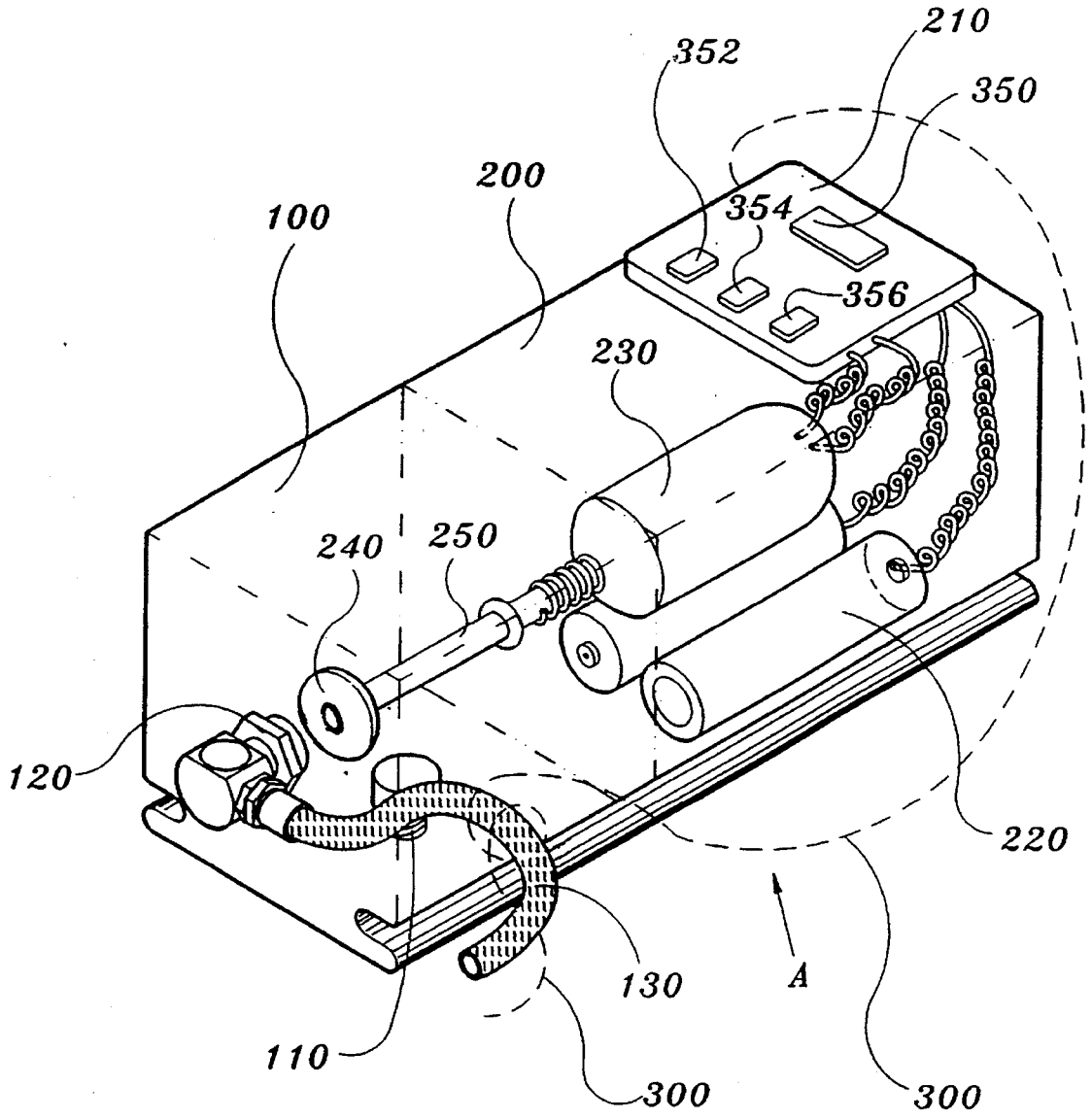
FIG. 1 is a schematic "transparent" perspective view showing an embodiment of the invention.
Figure 2A:
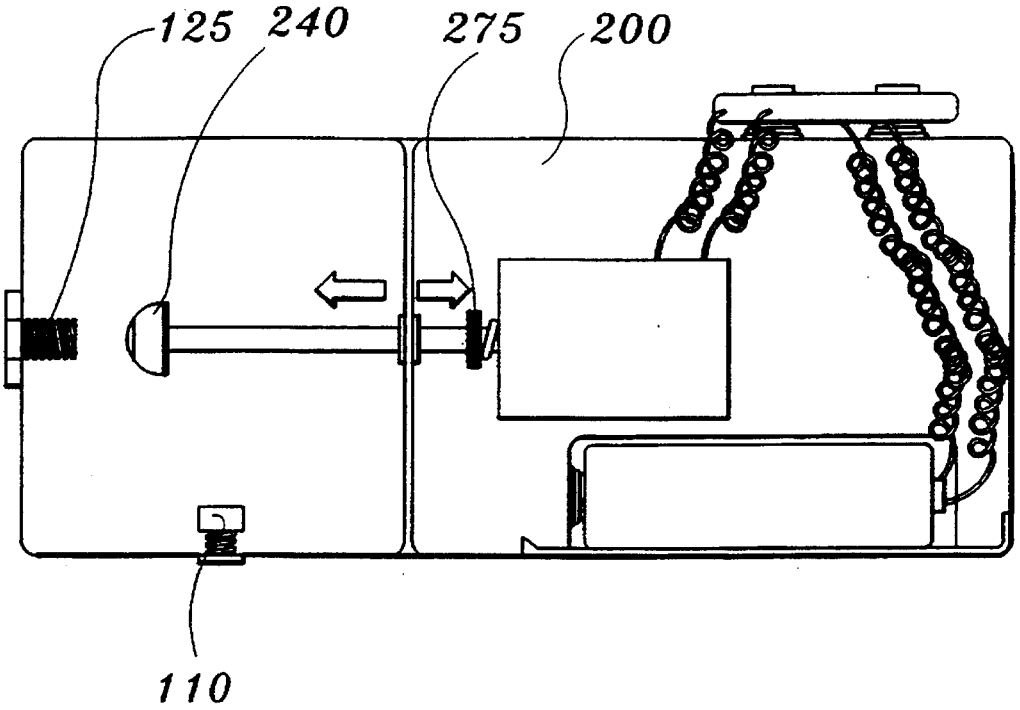
FIG. 2A is a side view in the direction of arrow A of FIG. 1 showing a valve open.
Figure 2B:
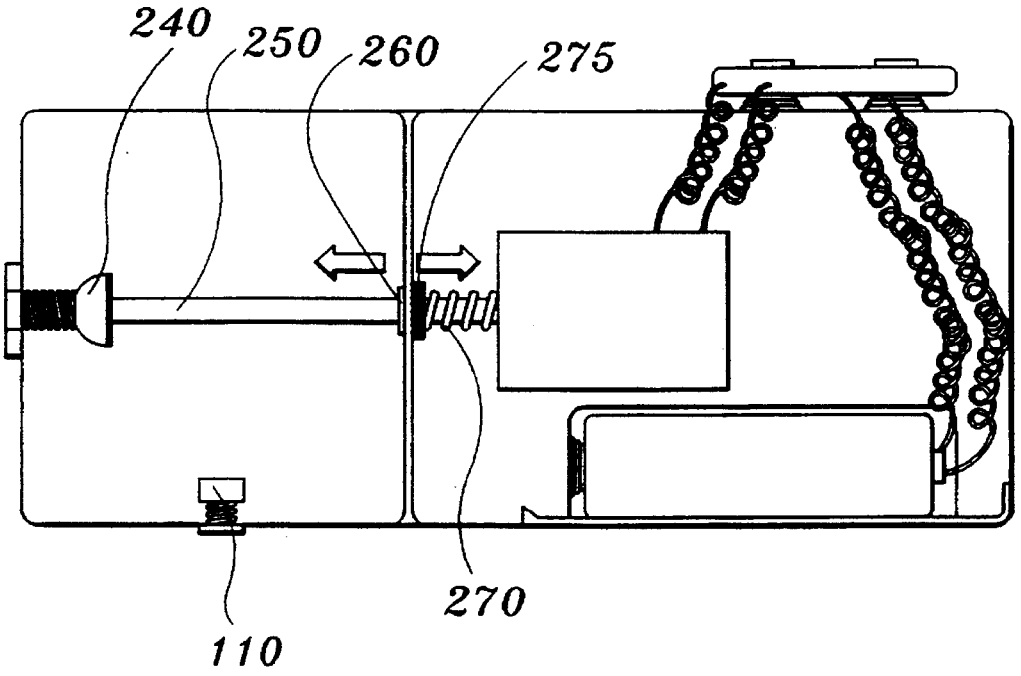
FIG. 2B is a view similar to FIG. 2A showing the valve closed.

The reservoir 100 is connected to a control unit 200 which houses a temperature and regulation circuit 210, a battery power supply 220 and valve actuating solenoid 230. The solenoid 230 is connected to a neoprene rubber valve member 240 via an actuator 250 which in response to actuation of the solenoid moves from the position shown in FIG. 2A in which the valve member is distant from a hollow bush 125 forming part of outlet 120 and which forms a valve seat to a position shown in FIG. 2B in which the valve member 240 effects a seal against bush 125. The actuator 250 passes through the wall of the reservoir 100 via a neoprene seal 260 and actuator 250 is biased in the sealing position shown in FIG. 2B by means of a spring 270 disposed between the solenoid 230 and a reaction member 275 connected to the actuator 250.

Figure 3:
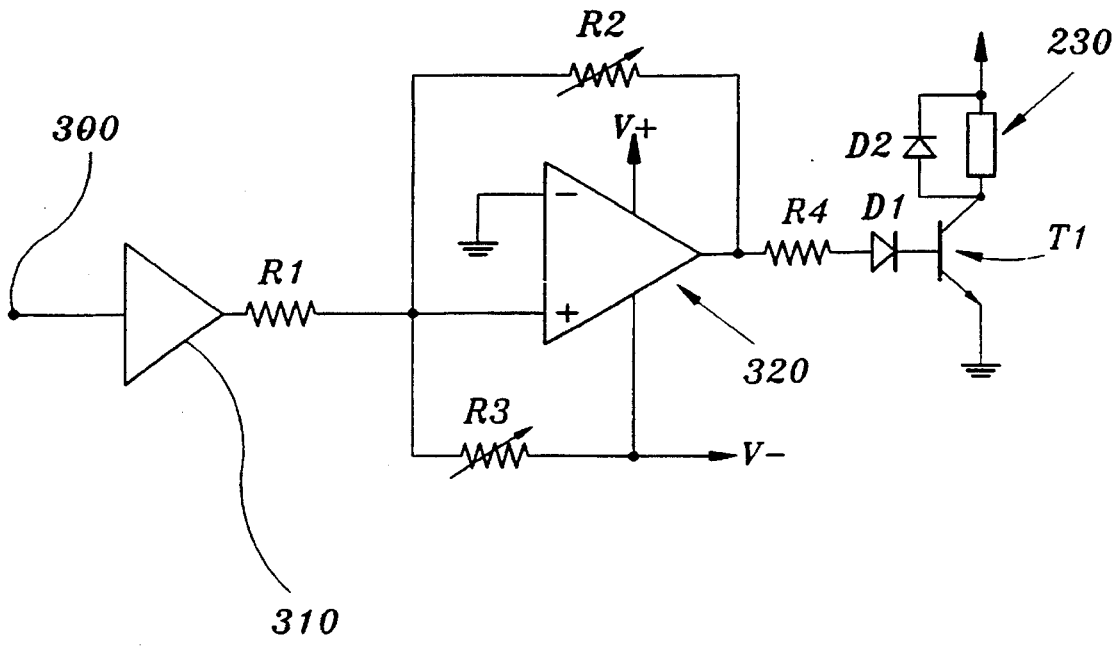
FIG. 3 is a schematic diagram of the temperature control circuitry of the embodiment of FIGS. 1 and 2.

The temperature control circuit 210 shown in more detail in FIG. 3. The circuit is connected to a temperature sensor, for example a thermos couple wire 300 which may be wound around a part of tube 130 as shown or disposed inside or on the surface of the control unit 200. A signal from the temperature sensor 300 is fed to a temperature voltage converter 310 and then to a comparator circuit 320. The comparator circuit 320 is biased by resistors R1–R4 and includes two variable resistors R2 and R3 which set upper and lower temperature threshold levels for the comparator 320 which will provide a high, ON signal when the upper threshold temperature is reached and provide a low OFF signal when the lower threshold temperature is reached. The signal from the comparator is fed via a diode D1 to a solenoid driving transistor T1 which when receiving the high ON signal from the comparator 320 actuates the solenoid 230.

The circuit 210 includes a display 350 for displaying current temperature or upper/lower threshold temperatures and keys for 352–356 for switching the device on and off and for adjusting the threshold temperatures.

Figure 4A:
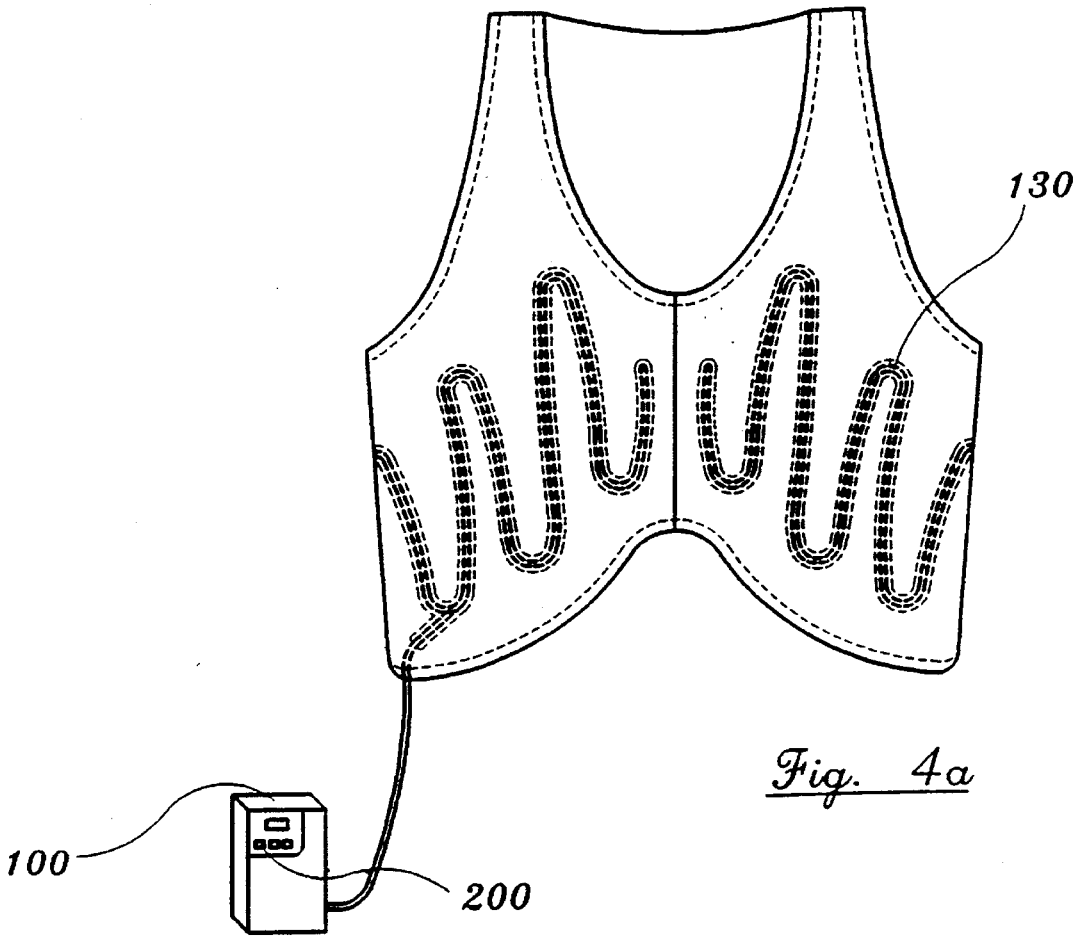
FIGS. 4*a* and 4*b* show front and back views respectively of an embodiment of the present invention mounted in an article of clothing.
Figure 4B:
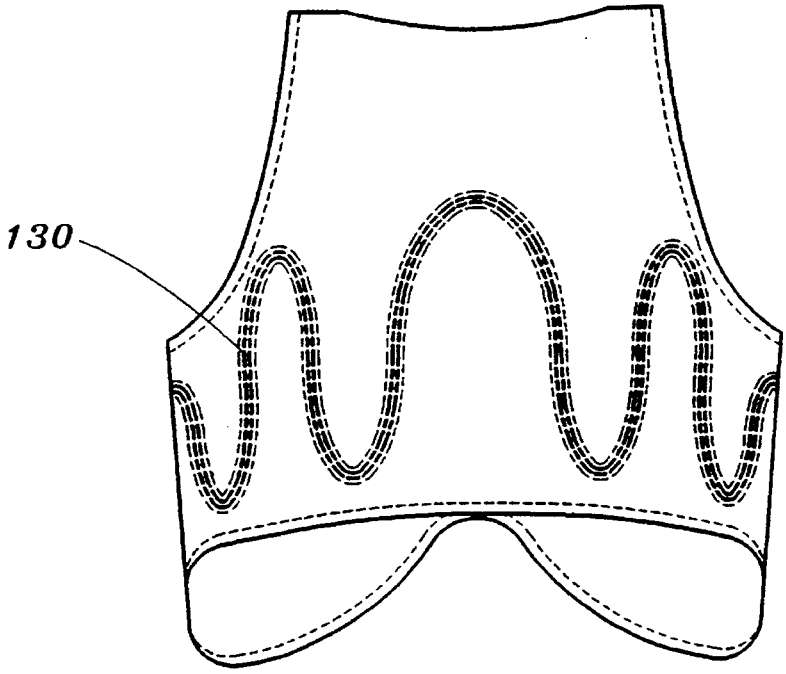
Figure 6A:
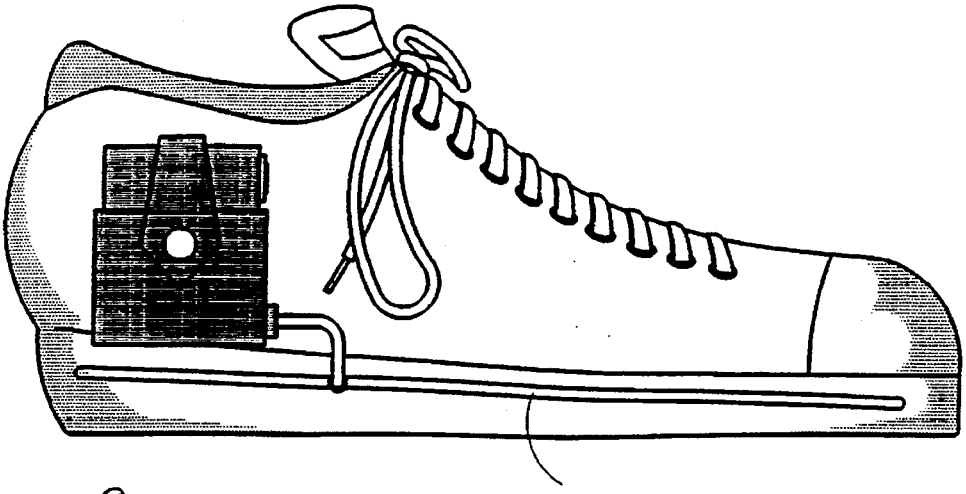
FIGS. 6*a*–6*c* show side, underneath and perspective views respectively of an embodiment of the invention mounted in an article of footwear.
Figure 6B:
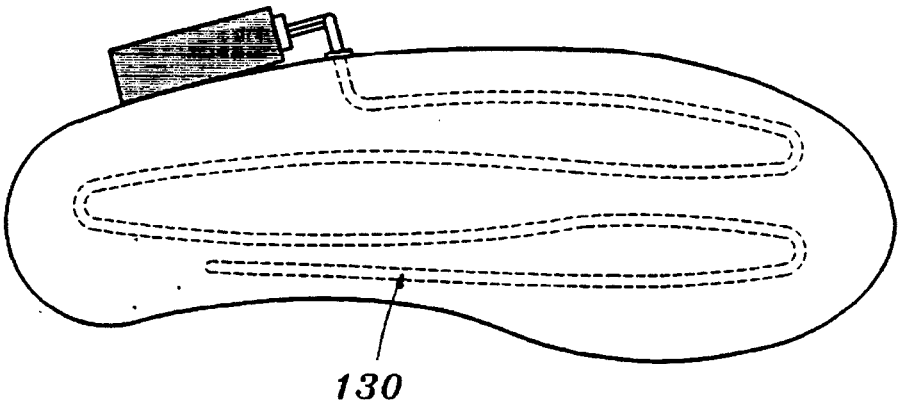
Figure 6C:
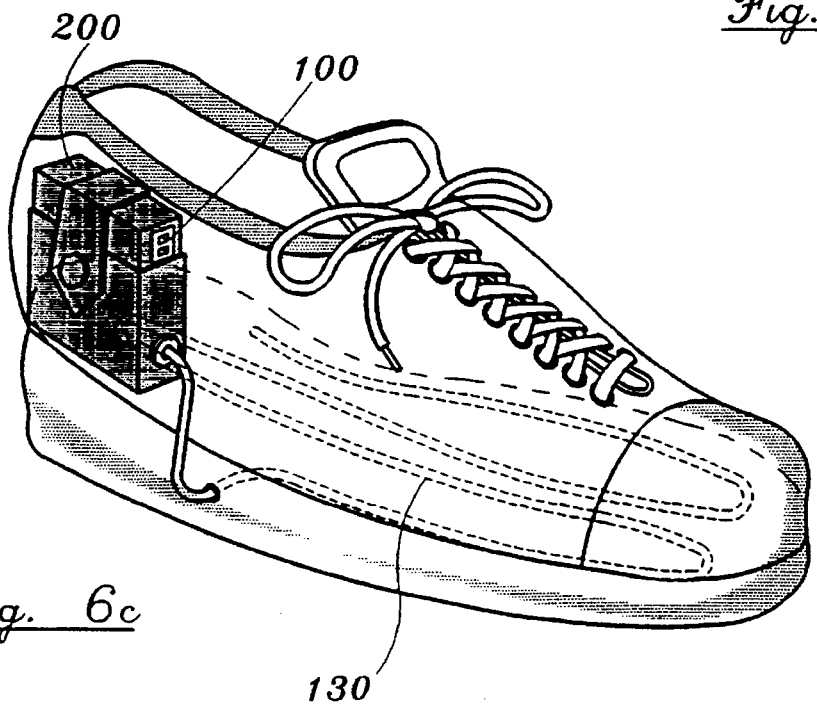

The tube 130 may be initially of heat insulating material protected by metal braid leading to a tube of plastics material such as PVC which is positioned in an item of clothing so as to lie adjacent to the skin. For example, the tube may be placed within the collar of a shirt, the lining of a jacket adjacent the shoulders or torso (see FIGS. 4*a* and 4*b*), in the inside sole of a shoe at the surface (see FIGS. 6*a*–6*c*) or in articles of underwear.

Figure 5A:
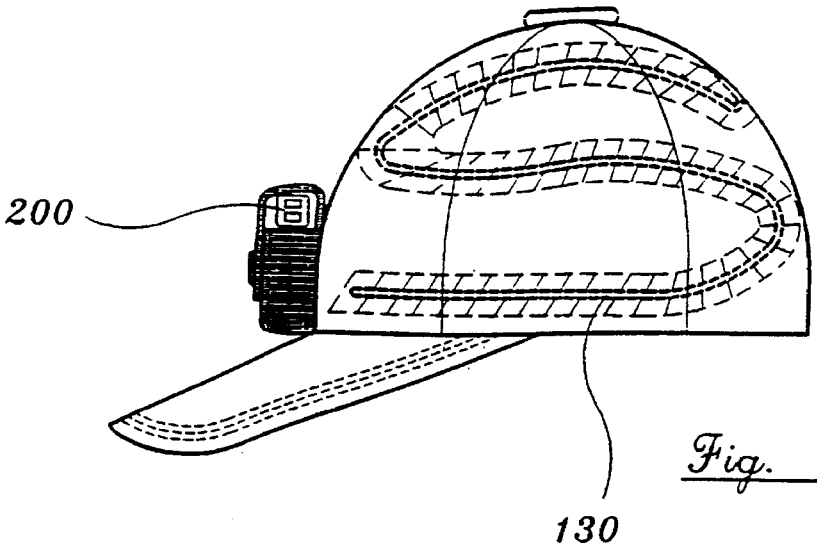
FIGS. 5*a*–5*c* show side, top and perspective views respectively of an embodiment of the invention mounted in an article of headgear.
Figure 5B:
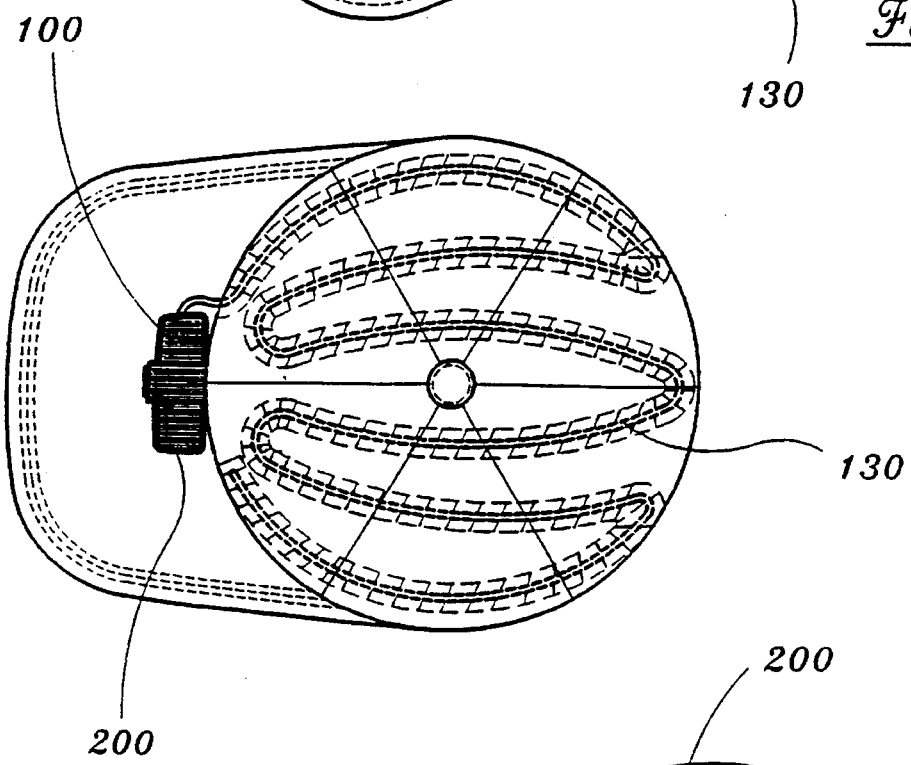
Figure 5C:
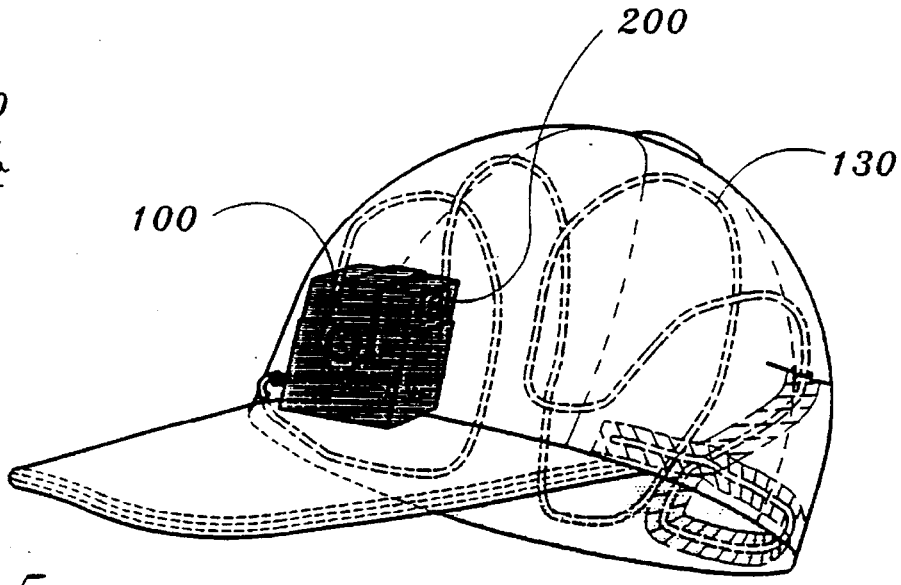

The reservoir 100 and control unit 200 can be of a size depending on the application. For example they could be the size of a personal stereo/cassette player and clipped to the belt, connected to the tubes in the clothing by means of a detachable connecter or, for applications for use in footwear the reservoir and control circuit could be implanted in the heel of a shoe. In some applications, for example in sports clothing, in which excess heat is usually present, leading to problems such as athletes foot, the device may be arranged to be permanently on once actuated thus eliminating the need for temperature control circuitry. The invention is equally applicable for use in headgear, (see FIGS. 5*a*–5*c*).

Preferably, the reservoir may be replenished by use of a master cylinder engaging with the reservoir through the refilling nipple 110, one-way valve being engageable by the cylinder in a similar manner to the way in which a cigarette lighter may be refilled with LPG from such a cylinder.

In use, when a temperature above the upper temperature threshold is sensed by the temperature control circuitry, the solenoid 230 acts to move the valve member 240 away from bush 125 thus opening the valve. As the gas in the reservoir is held in liquid form under pressure, this will expand through the open valve and be transported through tubing 300. As the gas expands, it gives of latent heat of evaporation cooling itself considerably. As the cool gas circulates through tube 300, heat is transferred through the walls of the tube to the user thus providing a cooling effect.

The invention has described above with reference to one embodiment. However, this is not to be construed as limitative. For example, although the thermos couple and temperature control circuit has been shown, this may be omitted in order to reduce weight and cost, with the user switching the device on and off as required. Furthermore, although the power supply has been shown as two cylindrical "pen lite" batteries, other power supplies may be used and, in particular, button-shaped nickel cadmium or lithium batteries may be used.

I claim:

1. Cooling apparatus comprising:

a portable reservoir for containing a gas under pressure;

temperature controlled valve means for releasing the gas from the reservoir, said temperature controlled valve means including a valve member adapted to seat against an outlet of the reservoir and a solenoid connected to a temperature controller including a temperature sensor for actuating the solenoid to open the valve once the sensed temperature increases beyond a predetermined threshold; and means for contacting a user or an article of clothing having a thermally conductive wall and connected to the valve means and into which gas is released, for conducting the cooling effect of the released gas through said wall to a region to be cooled.

2. Apparatus as claimed in claim 1 wherein the reservoir is for containing a liquified gas.

3. Apparatus as claimed in claim 2 wherein when the liquified gas is nitrogen.

4. Apparatus as claimed in claim 1 wherein the conducting means is adapted to be disposed in an article of clothing, footwear or head gear.

5. Cooling apparatus as claimed in claim 4 wherein the conducting means is formed from tubing.

6. Apparatus as claimed in claim 1 wherein the apparatus is disposed within an article of headgear.

7. Apparatus as claimed in claim 1 wherein the apparatus is disposed within an article of footwear.

8. Apparatus as claimed in claim 1 wherein the valve is closed once the temperature descends beyond a further threshold lower than the predetermined threshold.

9. Apparatus as claimed in claim 1 or claim 8 wherein the temperature sensor comprises a thermistor.

10. Apparatus as claimed in claim 1 wherein the temperature sensor is disposed adjacent to the conducting means.

11. Apparatus as claimed in claim 1 wherein the apparatus is portable.

* * * * *